US008494186B2

(12) United States Patent
Lee et al.

(10) Patent No.: US 8,494,186 B2
(45) Date of Patent: Jul. 23, 2013

(54) SOUND PLATE AND ELECTRONIC DEVICE EMPLOYING THE SAME

(75) Inventors: Gyeong-tae Lee, Uiwang-si (KR); Jong-bae Kim, Seoul (KR); Jong-in Jo, Suwon-si (KP)

(73) Assignee: Samsung Electronics Co., Ltd., Suwon-si (KR)

( * ) Notice: Subject to any disclaimer, the term of this patent is extended or adjusted under 35 U.S.C. 154(b) by 124 days.

(21) Appl. No.: 13/016,019

(22) Filed: Jan. 28, 2011

(65) Prior Publication Data

US 2011/0188678 A1 Aug. 4, 2011

(30) Foreign Application Priority Data

Feb. 2, 2010 (KR) ..... 10-2010-0009639

(51) Int. Cl.
*H04R 25/00* (2006.01)

(52) U.S. Cl.
USPC ..... 381/152; 381/333; 381/388

(58) Field of Classification Search
USPC ..... 381/306, 333, 152, 388
See application file for complete search history.

(56) References Cited

U.S. PATENT DOCUMENTS

| | | | | |
|---|---|---|---|---|
| 6,332,029 | B1 * | 12/2001 | Azima et al. | 381/152 |
| 6,415,035 | B1 * | 7/2002 | Shin et al. | 381/388 |
| 2002/0099891 | A1 | 7/2002 | Cole et al. | |
| 2005/0238196 | A1 | 10/2005 | Furuno et al. | |

FOREIGN PATENT DOCUMENTS

| | | | |
|---|---|---|---|
| JP | 11-168681 | A | 6/1999 |
| JP | 2008-211746 | A | 9/2008 |

OTHER PUBLICATIONS

Extended European Search Report issued Apr. 29, 2011 in countepart European Patent Application No. 11153100.0.

* cited by examiner

*Primary Examiner* — Suhan Ni
(74) *Attorney, Agent, or Firm* — Sughrue Mion, PLLC

(57) ABSTRACT

Provided are a sound plate and an electronic device employing the same. The sound plate includes at least one speaker unit disposed within a plate that is configured as a stand of the electronic device. Sound output by the at least one speaker is emitted through at least slit provided in a side surface of the plate.

19 Claims, 12 Drawing Sheets

SOUND PLATE AND ELECTRONIC DEVICE EMPLOYING THE SAME

CROSS-REFERENCE TO RELATED PATENT APPLICATION

This application claims priority from Korean Patent Application No. 10-2010-0009639, filed on Feb. 2, 2010, in the Korean Intellectual Property Office, the disclosure of which is incorporated herein in its entirety by reference.

BACKGROUND

1. Field

Exemplary embodiments relate to a sound plate and an electronic device employing the same, and more particularly, a sound plate and an electronic device employing the same in which a speaker system is separated from a main body of the electronic device.

2. Description of the Related Art

With the development of flat display panel (FDP) technologies, electronic devices such as digital televisions (TVs) have become slimmer. Thus, acoustic devices having a structure suitable for the slim electronic devices are required. For example, an acoustic device for a slim digital TV may include a down-firing type front speaker and a back-firing type woofer. The down-firing type front speaker is installed at a lower part of the bezel of the digital TV to emit moderate/high-pitched sounds to a lower side of the digital TV. The back-firing type woofer is installed at a rear surface of the digital TV to emit low-pitched sounds to a rear side and transfer the low-pitched sounds to a front side through the diffraction of sound waves. However, as electronic devices become slimmer, the degradation of sound quality is increased.

SUMMARY

Exemplary embodiments provide a sound plate suitable for an electronic device, such as an ultra-slim digital TV, having a slim structure, and an electronic device employing the same.

According to an aspect of an exemplary embodiment, there is provided a sound plate including at least one speaker unit; and a plate in which the at least one speaker unit is disposed, the plate including at least one slit through which a sound output from the at least one speaker unit is emitted, wherein the plate is configured as a stand to support a main body of an electronic device.

The at least one slit may be provided in a side surface of the plate, and the sound is emitted through the at least one slit in a forward direction without being reflected from a rear surface of the sound plate.

The at least one speaker unit may be disposed to allow an acoustic diaphragm to face a lower plate of the plate. Here, the at least one speaker unit may be disposed adjacent to the at least one slit.

The plate may include an upper plate and a lower plate which are coupled to each other such that an inner space is formed between the upper plate and the lower plate, and the at least one speaker unit may include a woofer module and a tweeter module, which are arranged in parallel to one another in the inner space between the upper plate and the lower plate of the plate.

The woofer module may include a frame which seals the upper plate and lower plate of the plate to enclose the woofer module within the upper plate and the lower plate.

The woofer module and the tweeter module may be disposed in a pair at a left side and a right side of the speaker module.

The at least one slit may be in one-to-one correspondence to the at least one speaker unit, and the sound output from the at least one speaker unit may be independently emitted through the corresponding at least one slit.

According to an aspect of another exemplary embodiment, there is provided an electronic device including a main body that performs a function; and a sound plate which includes at least one speaker unit; and a plate in which the at least one speaker unit is disposed, the plate including at least one slit through which a sound output from the at least one speaker unit is emitted, wherein the plate is configured as a stand which supports a main body.

The at least one slit may be defined in a side surface of the plate, and the sound emitted through the at least one slit in a forward direction without being reflected from a rear surface of the sound plate.

The at least one speaker unit may be disposed to allow an acoustic diaphragm to face a lower plate of the plate.

The plate may include an upper plate and a lower plate which are coupled to each other such that an inner space is formed between the upper plate and the lower plate, and the at least one speaker unit includes a woofer module and a tweeter module, which are arranged in parallel to one another in the inner space between the upper plate and the lower plate of the plate.

The woofer module may include a frame which seals the upper plate and lower plate to enclose the woofer module within the upper plate and the lower plate.

The woofer module and the tweeter module may be disposed in a pair at a left side and a right side of the speaker module.

The at least one slit may be in one-to-one correspondence to the at least one speaker unit, and the sound output from the at least one speaker unit may be independently emitted through the corresponding at least one slit.

The main body may include a display panel which displays an image.

The plate may be detachably coupled to the main body of the electronic device foldably coupled to a backside of the main body of the electronic device.

BRIEF DESCRIPTION OF THE DRAWINGS

The above and other aspects will become more apparent by describing in detail exemplary embodiments with reference to the attached drawings in which.

DETAILED DESCRIPTION OF EXEMPLARY EMBODIMENTS

Figure 1:
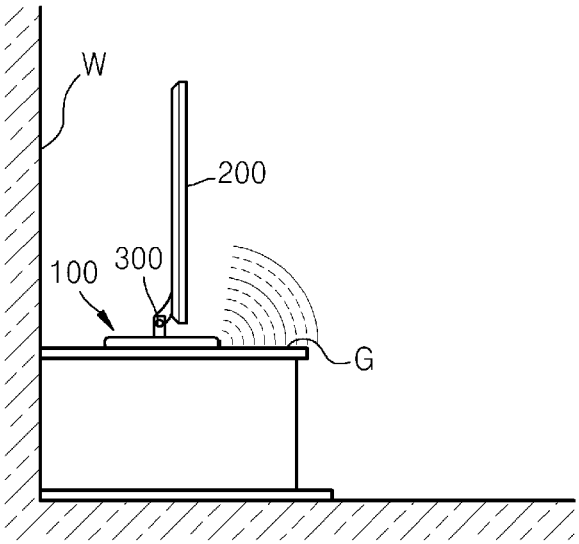
FIG. 1 is a schematic side view of an electronic device according to an exemplary embodiment.

The exemplary embodiments will now be described more fully with reference to the accompanying drawings. The inventive concept may, however, be embodied in many different forms and should not be construed as being limited to the exemplary embodiments set forth herein; rather, these exemplary embodiments are provided so that this disclosure will be thorough and complete, and will fully convey the inventive concept to those skilled in the art. In the drawings, like reference numerals denote like elements, and the size of each element in the drawings are exaggerated for clarity.

Figure 2:
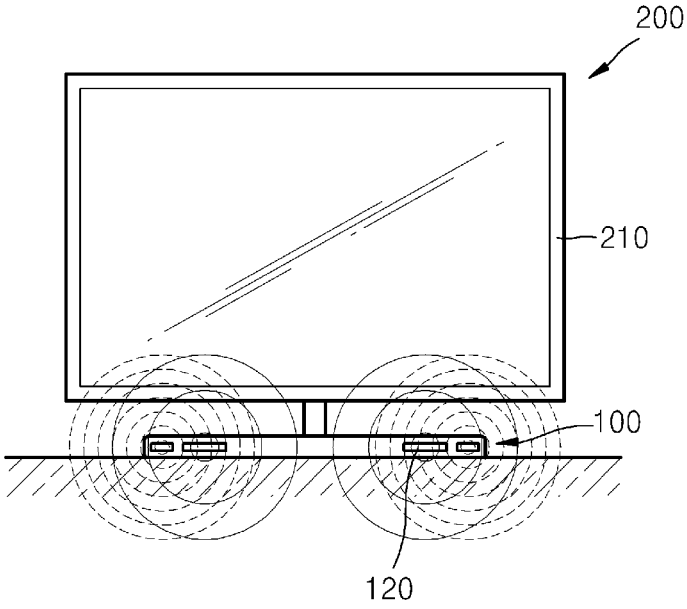
FIG. 2 is a front view of the electronic device of FIG. 1.

FIG. 1 is a schematic side view of an electronic device according to an exemplary embodiment, and FIG. 2 is a schematic front view of the electronic device of FIG. 1.

Referring to FIGS. 1 and 2, the electronic device of the exemplary embodiment has a structure in which a sound plate 100 is separated from a main body 200 of the electronic device. The sound plate 100 is coupled to the main body 200 through a coupling unit 300 and serves as a stand that supports the main body 200.

The electronic device of the present exemplary embodiment, for example, may be audio/video equipment such as a digital TV. The main body 200 may include a display panel 210, which performs preset functions and displays images, and other signal processors (not shown).

The sound plate 100 outputs sound according to an audio signal output from the main body 200 of the electronic device. The sound plate 100 is a slit-firing speaker system that emits sounds through a plurality of slits defined in a side surface thereof. The sound plate 100 serves as a speaker system as well as a stand support supporting the main body 200.

The coupling unit 300 couples the sound plate 100 to the main body 200. The exemplary embodiment is not limited to the specific structure or configuration of the coupling unit 300, and thus, the coupling unit 300 may be realized through various forms and structures known in the corresponding technical field. The audio signal output from the main body 200 may be transmitted to a speaker module (see reference numeral 130 of FIG. 4) within the sound plate 100 through a cable (not shown) passing through the coupling unit 300.

In general, a speaker system occupies a predetermined volume due to its mechanical structure, which may thereby restrict the ability to decrease the thickness of the body housing the speaker system. However, in the electronic device according to the present exemplary embodiment, since the sound plate 100, that is, the speaker system, is separated from the main body 200, the thickness of the main body 200 is not limited by the size and/or shape of the speaker system. The display panel 210 may be, for example, an ultra-slim flat panel such as a liquid crystal panel, an organic light emitting panel, and a plasma display panel so that the main body 200 may be slim. Furthermore, since the sound plate 100 is a vibration source that is separated from the main body 200, vibration-occurring problems of the main body 200 may be solved. Thus, a mechanical design of the main body 200 may focus on other issues such as overcoming thermal emission limitations.

Figure 3:
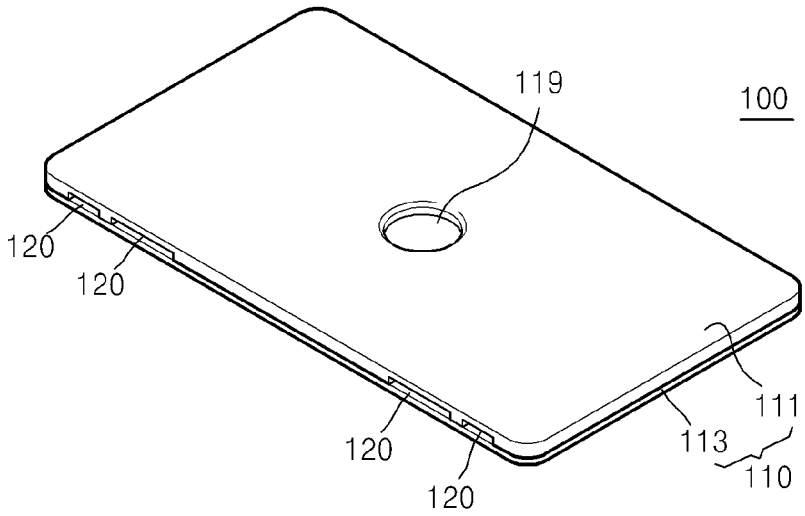
FIG. 3 is a perspective view illustrating only a sound plate of the electronic device of FIG. 1, according to an exemplary embodiment.
Figure 4:
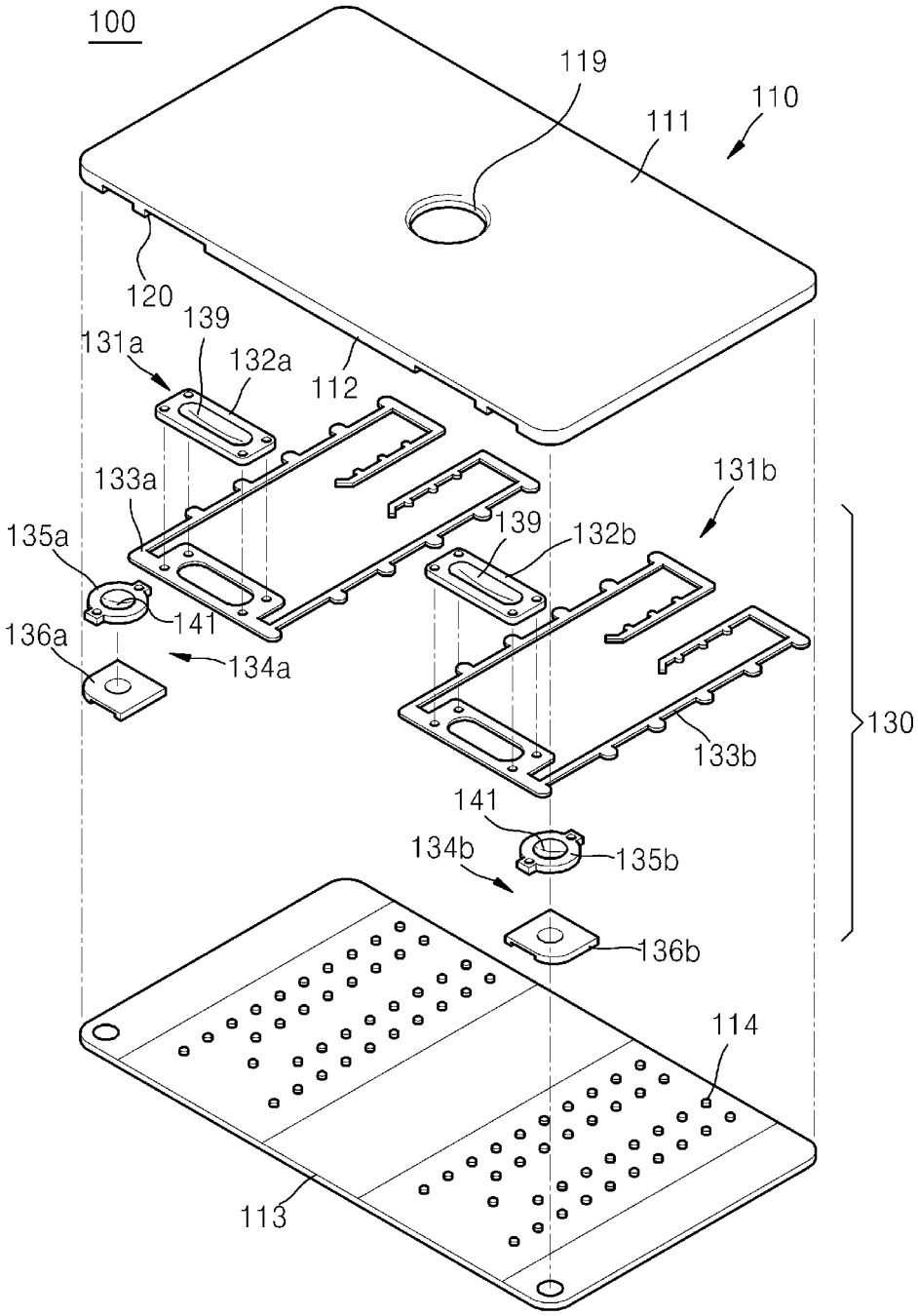
FIG. 4 is an exploded perspective view of the sound plate of FIG. 3, according to an exemplary embodiment.

FIG. 3 is a perspective view illustrating only the sound plate 100 of the electronic device of FIG. 1, and FIG. 4 is an exploded perspective view of the sound plate 100 of FIG. 3, according to the current exemplary embodiment.

Referring to FIGS. 3 and 4, the sound plate 100 includes a plate 110 and a speaker module 130 disposed within the plate 110. The plate 110 may have a thin flat plate shape in which an upper plate 111 and a lower plate 113 are coupled to one another.

A predetermined space is defined between the upper plate 111 and the lower plate 113 to dispose the speaker module 130 therein. A coupling part 119 for coupling the upper plate 111 of the plate 110 to the main body 200 is defined in the upper plate 111 of the plate 110. The coupling part 119 may have a simple groove or a groove with a female screw structure. The shape of the coupling part 119 may vary according to a coupling method of the coupling unit 300.

A plurality of slits 120 are defined in a side surface 112 of the plate 110 to emit sounds output from the speaker module 130. The number of slits 120 may be in the same as the number of speaker units included in the speaker module 130. For example, as described below, when the speaker module 130 includes a pair of woofer modules 131*a* and 131*b* and a pair of tweeter modules 134*a* and 134*b*, four slits 120 may be provided to independently emit sounds output from the pair of woofer modules 131*a* and 131*b* and the pair of tweeter modules 134*a* and 134*b*.

Each of the plurality of slits 120 is designed to have a thickness (see reference letter T of FIG. 6) less than a wavelength of each of the sounds emitted through the plurality of slits 120 to serve as an acoustic center of the sound emission of the plurality of slits 120. For example, each of the plurality of slits 120 may be designed to have a thickness T less than one quarter of about 17 mm, which is a wavelength of an audible limit frequency. The plate 110 may be designed with sufficiently thin thickness so that the emitted sounds are negligibly reflected from the side surface 112 of the plate 110. For example, the plate 110 may be designed with a thickness of less than about 20 mm. Also, the plurality of slits 120 may be disposed at a lower portion of the side surface 112 of the plate 110. The plurality of slits 120 may satisfy a ground plane radiation condition, i.e., in a forward direction without being first reflected, as will be described in more detail later.

The speaker module 130 may include the pair of woofer modules 131*a* and 131*b* and the pair of tweeter modules 134*a* and 134*b*. The woofer modules 131*a* and 131*b* and the tweeter modules 134*a* and 134*b* may be horizontally arranged in bilateral symmetry with respect to the plate 110. For example, as shown in FIG. 4, the pair of woofer modules 131*a* and 131*b* may be symmetrically arranged on both left and right sides of a central portion of the plate 110, and the pair of tweeter modules 134*a* and 134*b* may be symmetrically arranged on both left and right sides of the outside of the central portion of the plate 110. Also, the woofer modules 131*a* and 131*b* and the tweeter modules 134*a* and 134*b* may be disposed adjacent to the plurality of slits 120.

Each of the woofer modules 131*a* and 131*b* may include woofers 132*a* and 132*b* and frames 133*a* and 133*b*, respectively.

Figure 5:
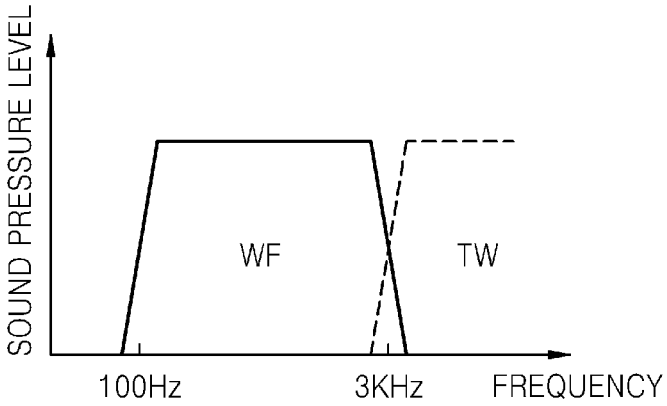
FIG. 5 is a view illustrating an example of a frequency band of a woofer and a tweeter of the sound plate of FIG. 3.

The woofers 132*a* and 132*b* may be used as a speaker for a low frequency range. For example, as shown in FIG. 5, the woofers 132*a* and 132*b* may be designed to output a moderate/low-pitched sound WF having a frequency band of about 100 Hz to about 3 kHz. The woofers 132*a* and 132*b* may be disposed to allow acoustic diaphragms 139 to face the lower plate 113. Here, the acoustic diaphragms 139 are spaced a predetermined distance from the lower plate 113 in consideration of the vibration. Each of the frames 133*a* and 133*b* has a holder structure for respectively holding the woofers 132*a* and 132*b* at one side thereof. Also, each of the frames 133*a* and 133*b* has a wall structure for sealing the upper plate 111 and the lower plate 113 at the other side thereof. A space sealed by each of the frames 133*a* and 133*b* between the upper plate 111 and the lower plate 113 serves as an enclosure for amplifying the low-pitched sound output from the woofers 132*a* and 132*b*. As the upper plate 111 and the lower plate 113 of the plate 110 are used as the enclosure of the woofers 132*a* and 132*b*, an ultra-slim size of sound plate 100 may be realized. Furthermore, the upper plate 111 and the lower plate 113 of the plate 110 may easily prevent the sound plate 100 from self-vibrating by the low-pitched sound. Also, the frames 133*a* and 133*b* serve as a support to maintain a state in which the upper plate 111 and the lower plate 113 of the plate 110 are spaced from each other.

A plurality of screw holes 114 for screw coupling or ribs (not shown) may be disposed in/on the upper plate 111 and/or the lower plate 113 of the plate 110. The screw holes 114 or ribs may be disposed at points at which the self-vibration strongly occurs by the low-pitched sound output from the woofers 132*a* and 132*b*. In addition, the screw holes 114 or ribs may reinforce the rigidity of the plate 110.

Each of the tweeter modules 134*a* and 134*b* may include tweeters 135*a* and 135*b* and tweeter holders 136*a* and 136*b*, respectively.

The tweeters 135*a* and 135*b* may be used as a speaker for a high frequency range. For example, as shown in FIG. 5, the tweeters 135*a* and 135*b* may be designed to output a high-pitched sound having a frequency band less than about 3 kHz. Although a frequency band in which frequency bands of the woofer modules 131*a* and 131*b* overlap with those of tweeter modules 134*a* and 134*b* is about 3 kHz in FIG. 5, the present exemplary embodiment is not limited thereto. For example, the overlapping frequency band may vary according to design. The tweeters 135*a* and 135*b* are disposed to allow the acoustic diaphragms 141 to face the lower plate 113. Here, each of the acoustic diaphragms of the tweeters 135*a* and 135*b* is spaced a predetermined distance, for example, about 0.3 mm from the lower plate 113 in consideration of vibration. Furthermore, the acoustic diaphragms 141 of the tweeters 135*a* and 135*b* may be inclined toward an adjacent slit 120. Thus, radiation directions of the sounds may be inclined toward the slits 120.

Figure 6:
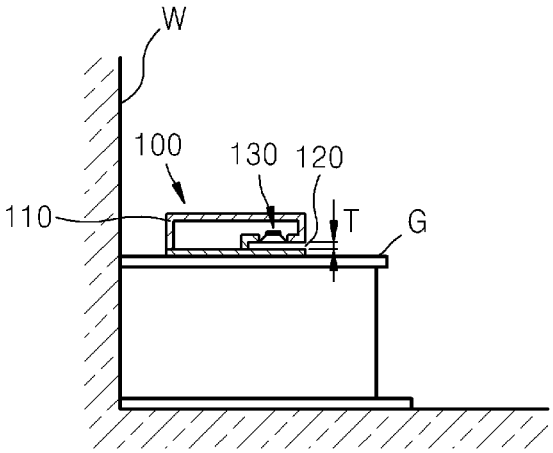
FIG. 6 is a schematic sectional view illustrating a ground plane radiation of the sound plate of FIG. 3.

FIG. 6 is a schematic sectional view illustrating a ground plane radiation of the sound plate 100. Referring to FIG. 6, the sound plate 100 may be placed on a bottom surface G. Since the plurality of slits 120 are defined at the lower portion of the side surface 112 of the plate 110, the plurality of slits 120 are disposed adjacent to the bottom surface G, i.e., a ground. Also, since each of the plurality of slits 120 has a thickness T less than a wavelength of the sound emitted from the speaker module 130, the plurality of slits 120 may be interpreted as an acoustic center of the sound emission. Thus, the sound plate 100 of the present exemplary embodiment may satisfy the ground plane radiation condition in which the sound is emitted upwardly from the bottom surface at a solid angle of about $2\pi$. That is, the sound is emitted in a forward direction from the slit without first being reflected, and is emitted at an angle even with the bottom surface G and emitted at angles upwardly from the bottom surface G up to about $2\pi$. As the sound plate 100 realizes the ground plane radiation, the output sound may not be reflected at a rear side to secure sound quality similar to that of a front-firing type speaker.

Figure 7:
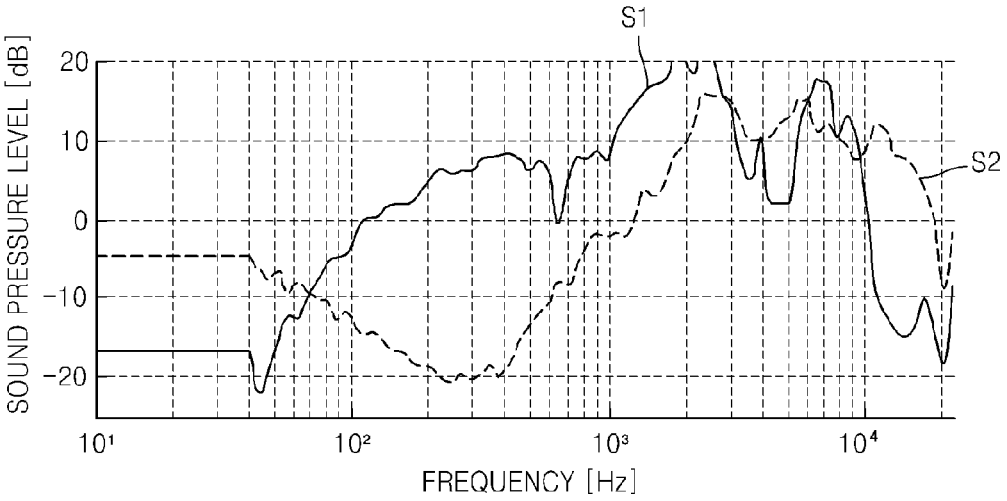
FIG. 7 is a view illustrating a sound pressure level before equalization in the electronic device of FIG. 1.
Figure 8:
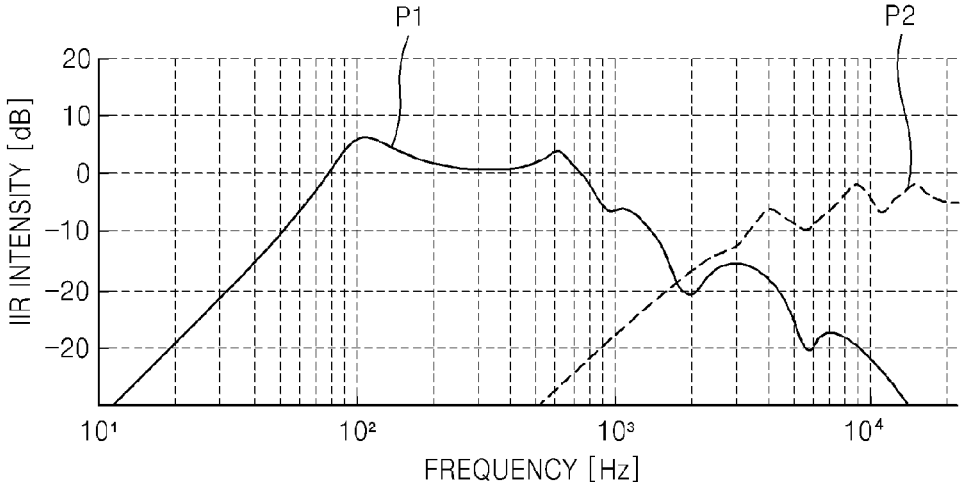
FIG. 8 is a view illustrating an example of a parametric equalizer (PEQ) set-up in the electronic device of FIG. 1.
Figure 9:
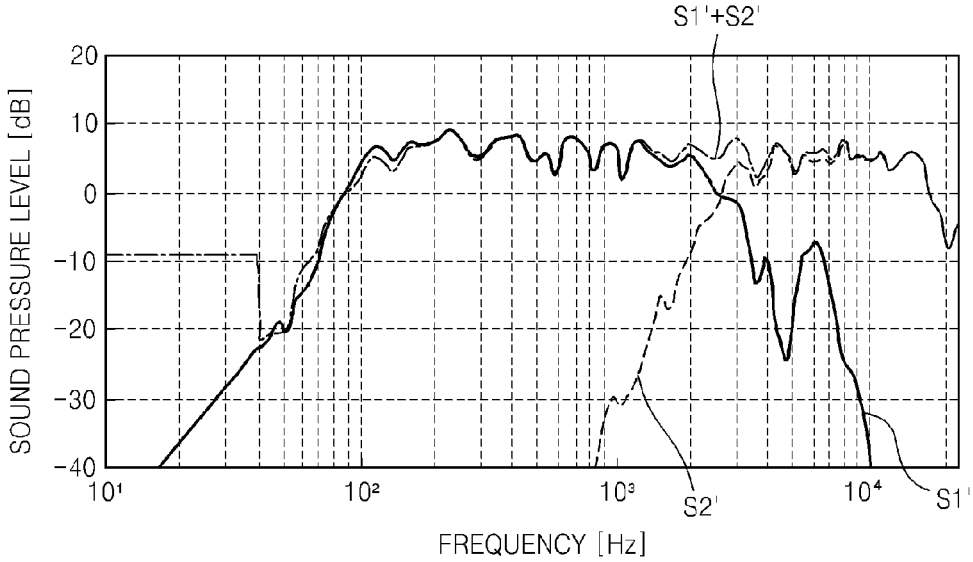
FIG. 9 is a view illustrating a sound pressure level after equalization in the electronic device of FIG. 1.

Equalization of the electronic device according to the present exemplary embodiment will be described below with reference to FIGS. 7 to 9.

The equalization represents a signal processing of adjusting a frequency response of an audio signal demodulated in the main body 200 of the electronic device. Thus, the equalization is used for correcting recording or speaker characteristics. In the present exemplary embodiment, the equalization is performed by reflecting the slit-firing speaker system in which the sound plate 100 satisfies the ground plane radiation condition. For example, the equalization may be realized by a parametric equalizer (PEQ).

For equalizing, the sound plate 100 is disposed below the main body 200, and a sound pressure level is measured at a front side. FIG. 7 illustrates an example of a frequency response before the equalization. In FIG. 7, a solid line 51 represents a sound pressure waveform of the woofers (see reference numerals 131*a* and 131*b* of FIG. 4), and a dashed line S2 represents a sound pressure waveform of the tweeters (see reference numerals 135*a* and 135*b* of FIG. 4). After the sound pressure level is measured before the equalization, a crossover frequency is set based on the measured result. FIG. 8 illustrates an example of an adjustment value of the PEQ. That is, equalizer filter coefficients are illustrated as a waveform of an infinite impulse response (IIR) with respect to a frequency axis. A solid line P1 represents a PEQ value with respect to the woofers 131*a* and 131*b*, and a dashed line P2 represents a PEQ value with respect to the tweeters 135*a* and 135*b*. FIG. 9 illustrates simulation results equalized by emphasizedly and de-emphasizedly processing the audio signal, which is demodulated by setting the PEQ as shown in FIG. 8, according to frequency bands. In FIG. 9, a solid line S1' represents a sound pressure waveform of the woofers 131*a* and 131*b* equalized by the PEQ, and a dashed line S2' represents a sound pressure waveform of the tweeters 135*a* and 135*b* equalized by the PEQ. Referring to FIG. 9, it is seen that a sound pressure waveform S1'+S2' of the sum of the sound pressure waveforms of the woofers 131*a* and 131*b* and the tweeters 135*a* and 135*b* is relatively flat over the whole frequency band.

In case of a down-firing type front speaker of the related art, a sound is output downward. Thus, when a high frequency sound is amplified by a PEQ, non-linear distortion increases, as well as, amplifier saturation occurs before the high frequency sound reaches a maximum volume. That is, there is a limitation on an effect of PEQ amplification. On the other hand, as shown in FIGS. 7 to 9, the sound plate 100 of according to the present exemplary embodiment expects superior low frequency extension and high frequency range recording having high articulation through adapted equalization.

Figure 10:
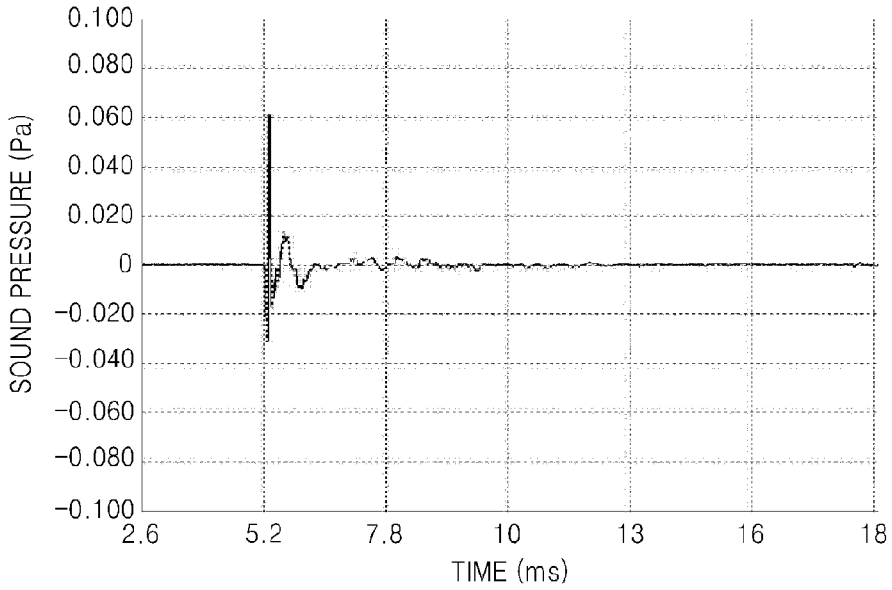
FIG. 10 is a view of impulse response characteristics in the electronic device of FIG. 1.

FIG. 10 is a view of impulse response characteristics in the electronic device of FIG. 1. As described above, the sound plate 100 is a slit-firing type speaker satisfying the ground plane radiation condition. The sound emitted from the sound plate 100 proceeds toward a front side without being reflected by a wall at a rear side. Thus, as shown in FIG. 10, the sound plate 100 has a very clean impulse response characteristic similar to that of a front-firing type speaker.

Figure 11:
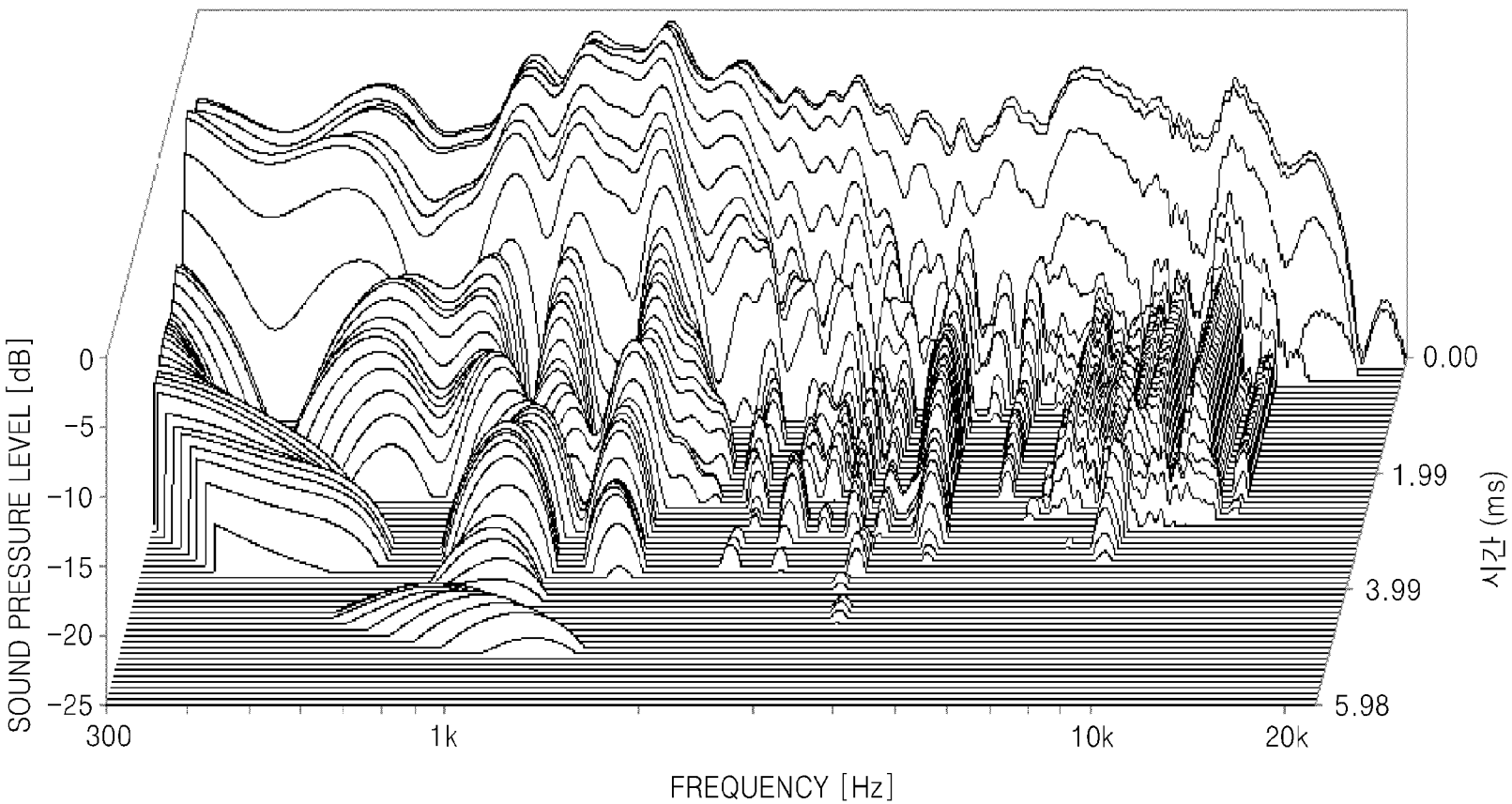
FIG. 11 is a view of frequency response characteristics in the electronic device of FIG. 1.

FIG. 11 illustrates frequency response decay characteristics in the electronic device according to the present exemplary embodiment. In the case of the down-firing type front speaker of the related art, a bottom-reflected sound and a backside-reflected sound overlap each other, and a frequency response in a moderate/high frequency band is very poor due to slow decay. On the other hand, referring to FIG. 11, it is seen that a frequency response in a moderate/high frequency band of about 5 kHz to about 20 kHz is cleaned in a short time. In the electronic device of the present exemplary embodiment, distortion due to the reflected sound is significantly reduced in a short time.

Figure 12:
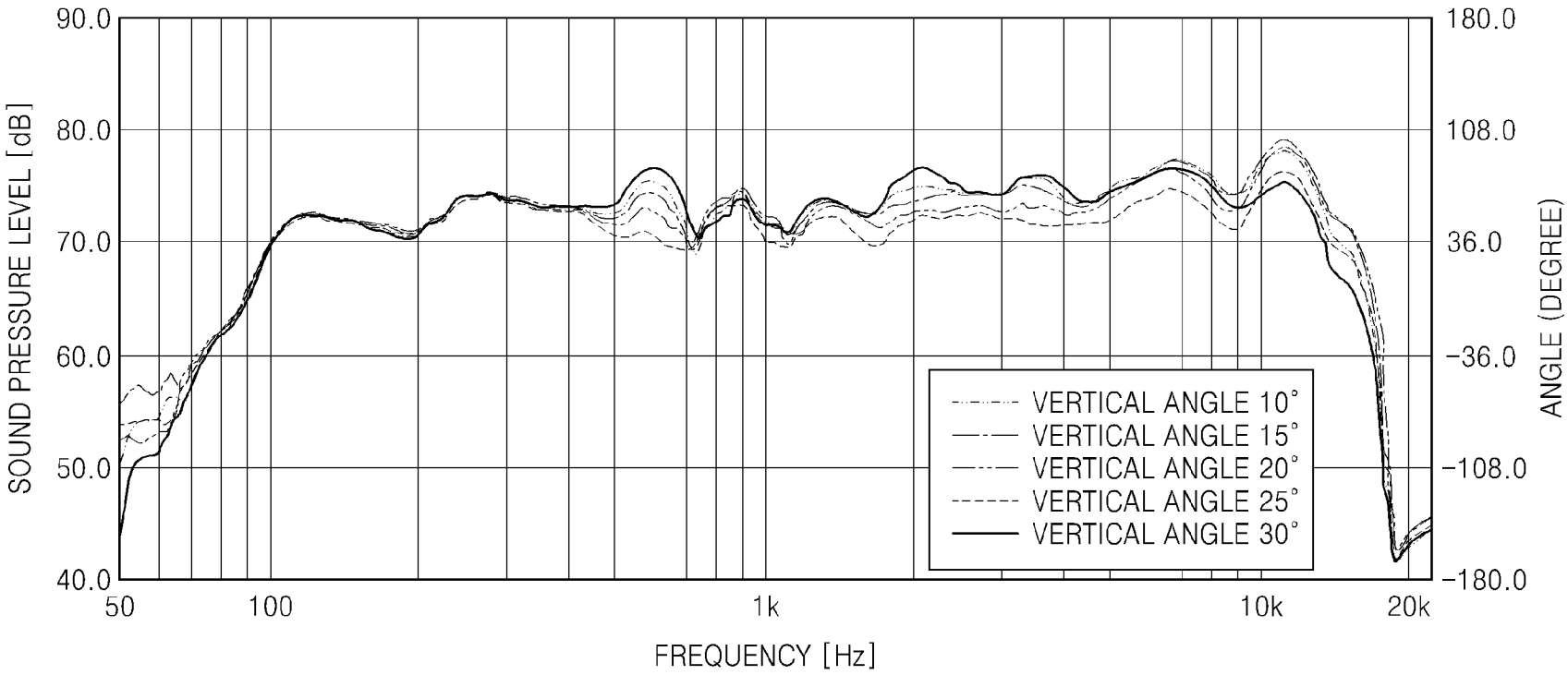
FIGS. 12 and 13 are views of vertical directivity characteristics in the electronic device of FIG. 1.
Figure 13:
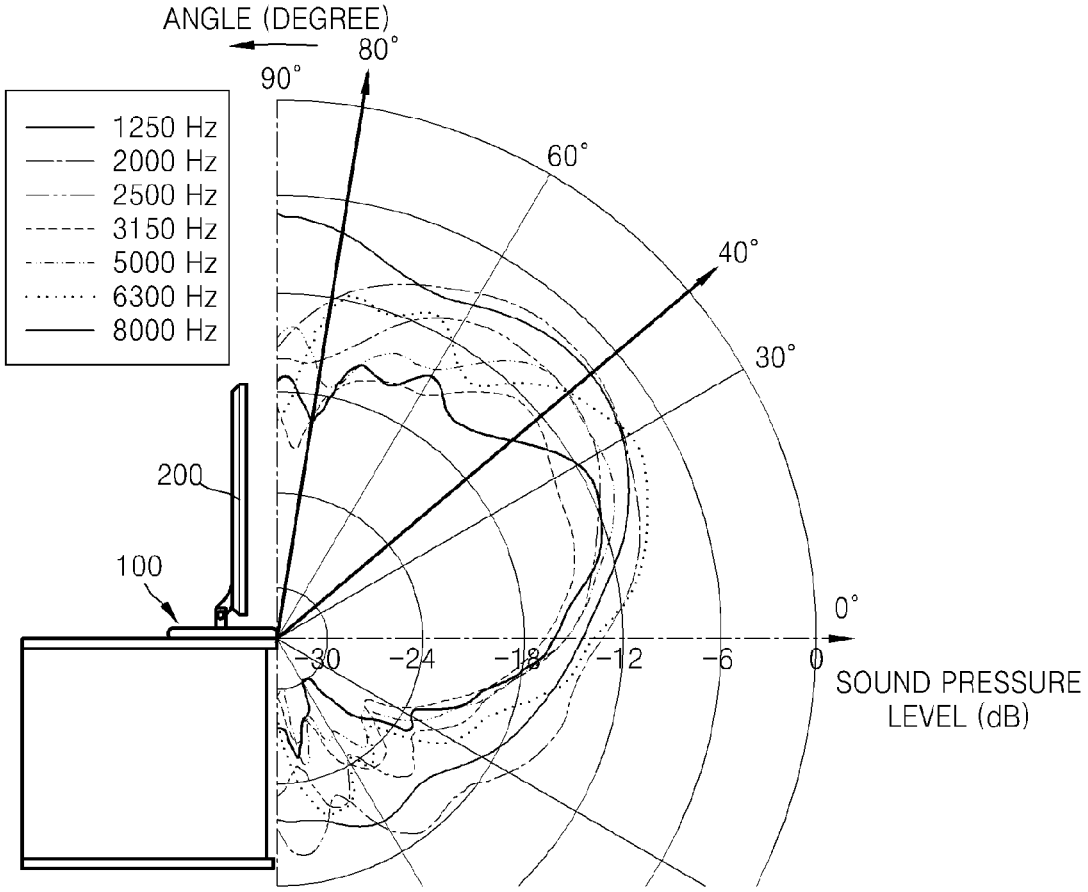
Figure 14:
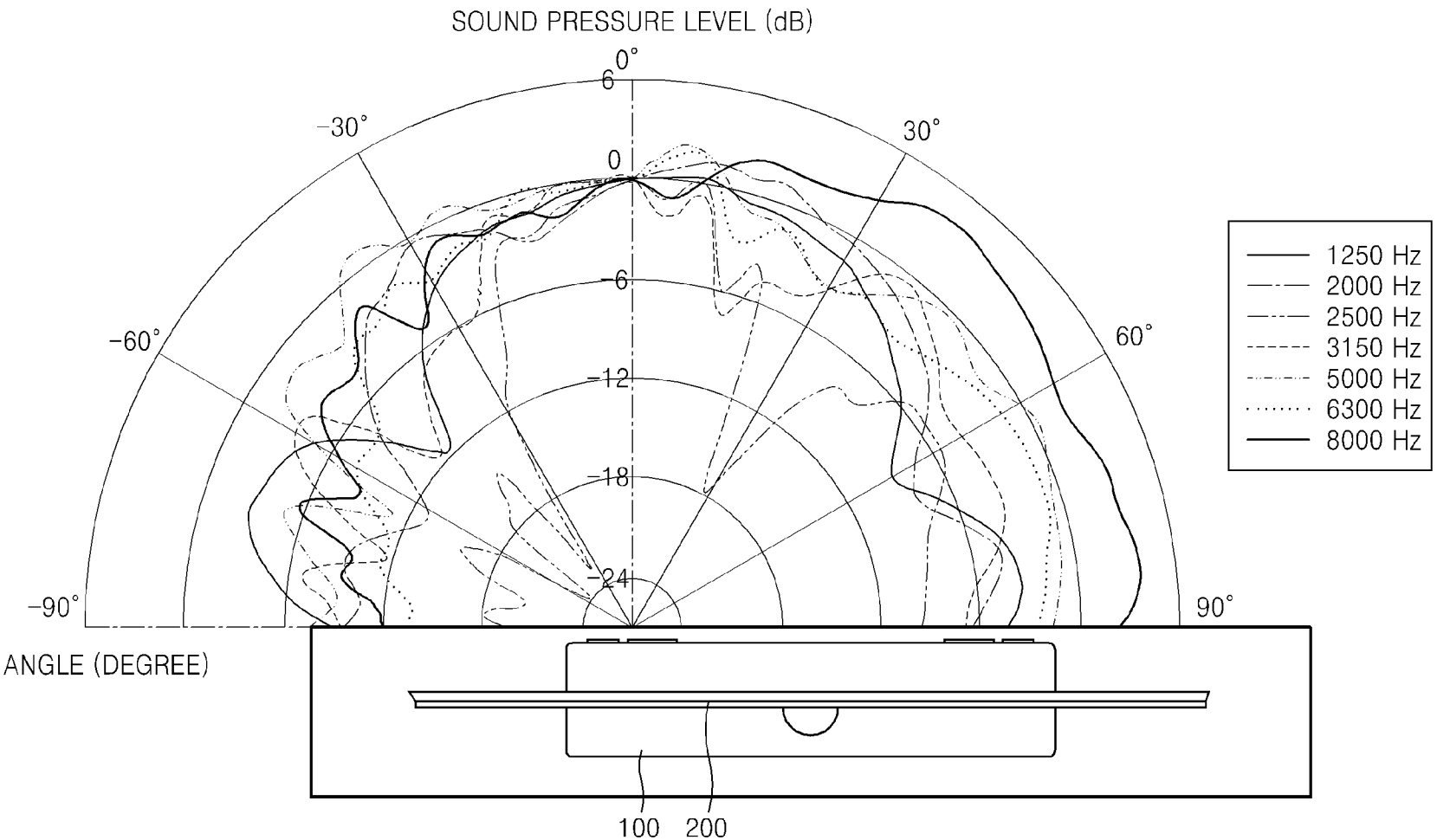
FIG. 14 is a view of horizontal directivity characteristics in the electronic device of FIG. 1.

FIGS. 12 and 13 illustrate vertical directivity characteristics in the electronic device of the present exemplary embodiment, and FIG. 14 illustrates horizontal directivity characteristics in the electronic device of the present exemplary embodiment.

Referring to FIG. 12, as the electronic device of the exemplary embodiment satisfies the ground plane radiation condition, a sound pressure level variation of a frequency response at a vertical angle of about 10 degrees to about 30 degrees is approximately ±3 dB, that is, very stable in terms of vertical directivity. Also, as the electronic device of the present exemplary embodiment satisfies the ground plane radiation condition, the electronic device emits sound through a radiation angle of about 2π upwardly from the bottom surface G. Thus, an acoustic axis is displaced in an upward direction. Referring to FIG. 13, in terms of the vertical directivity, the acoustic axis is displaced at an angle of about 40 degrees in an upward direction of the sound plate 100. Since the acoustic axis is displaced in the upward direction, it is seen that the reduction of a high frequency sound pressure level does not nearly occur at a front surface of the electronic device. Furthermore, it is seen that a beam thickness of an acoustic major lobe is widely formed within an angle of approximately 80 degrees over the whole frequency band. As described above, according to the ground plane radiation, the electronic device of the present exemplary embodiment may have optimum sweet spots at a center and the front surface thereof.

Referring to FIG. 14, in terms of horizontal directivity, since the beam thickness of the acoustic major lobe is substantially large over the whole frequency band, a sweet spot may be widely formed. Referring to a curve of a frequency band of about 2,500 Hz, which is the crossover frequency band in FIG. 14, it is seen that a large number of nodal surfaces is generated on a beam pattern of the crossover frequency band. The nodal surfaces may be restrained by minimizing an interference band between the woofer and the tweeter using a low pass filter (LPF) and a high pass filter (HPF) having a high order slope.

In case of a slim digital TV employing a back-firing type woofer of the related art, a low-pitched sound is emitted to a backside to diffract the low-pitched sound, thereby transferring the low-pitched sound to a front side. However, since the back-firing type woofer excites a back cover of the digital TV to generate unnecessary vibration and an acoustic mode, sound playback and articulation with respect to the low-pitched sound are deteriorated. Also, sound pressure dip due to a path difference of a rear-side sound occurs according to a listening position. On the other hand, according to the electronic device of the present exemplary embodiment, since the sound plate 100 is a speaker system that is disposed on the stand, vibration is not generated at the main body 200 of the electronic device thereby improving the sound playback and articulation with respect to the low-pitched sound. Also, the sound pressure dip due to the path difference of the rear-side sound does not occur. Furthermore, since the self vibration of the sound plate 100 is restrained by a weight of the main body 200, the electronic device is strong against vibration. Also, in the electronic device of the present exemplary embodiment, since the woofer and the tweeter are disposed adjacent to each other, the sound pressure dip is not nearly generated according to the listening position when a high order filter is used as the PEQ.

Figure 15:
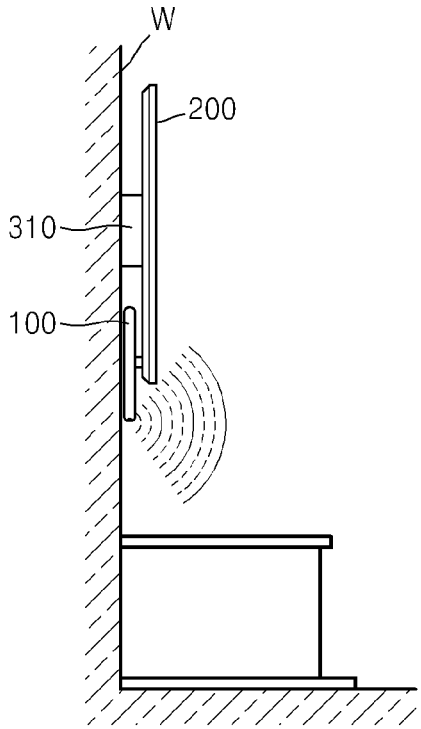
FIG. 15 is a view of a modified example of the electronic device of FIG. 1.

Although the stand type sound plate is used in the electronic device of the present exemplary embodiment described with reference to FIGS. 1 to 14, the present inventive concept is not limited thereto. For example, a wall mount type sound plate may be used in the electronic device of the present exemplary embodiments. FIG. 15 is a view of a modified example of the electronic device of the exemplary embodiment. In the modified example of the electronic device, after the sound plate 100 is detached, the sound plate 100 is re-installed on a backside of the main body 200 or folded onto the backside. A well-known coupling unit may be used as such a re-installable coupling structure or foldable coupling structure. As shown in FIG. 15, the side surface in which the slits (see reference numeral 120 of FIG. 2) of the sound plate 100 are defined may extend from a lower side of the main body 200. The main body 200 is hung on a wall W with a separate coupling unit 310.

When the sound plate 100 is folded onto the backside of the main body 200, the slits (see reference numeral 120 of FIG. 2) of the sound plate 100 are adjacent to the wall W. Here, points at which the slits (see reference numeral 120 of FIG. 2) of the sound plate 100 are defined may be understood as an acoustic center of the sound emission. Thus, it may be interpreted that the sound is emitted from the wall W toward the front side. That is, the wall W may be interpreted as a ground. Thus, it may be seen that the sound plate 100 according to the modified example satisfies the ground plane radiation condition.

Figure 16:
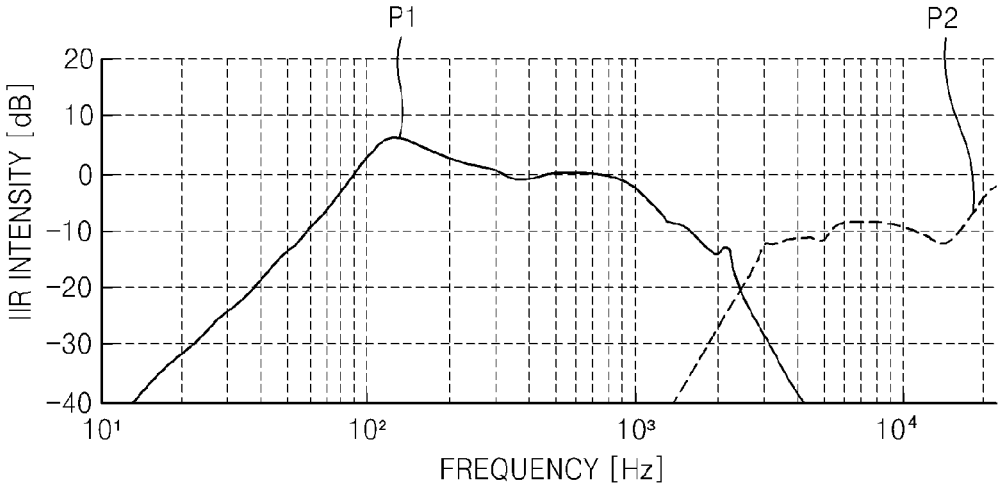
FIG. 16 is a view illustrating an example of a PEQ set-up in the electronic device of FIG. 15.
Figure 17:
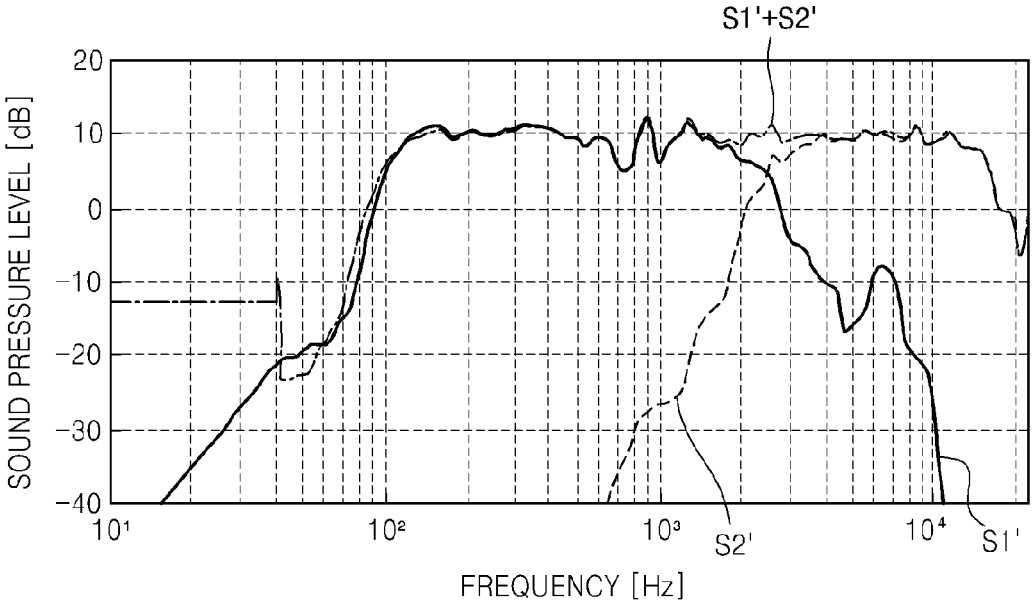
FIG. 17 is a view illustrating a sound pressure level after equalization in the electronic device of FIG. 15.

Since a sound emission point and listening position of the electronic device according to the modified example are different from those of the previously described exemplary embodiment, a PEQ set-up is different from that of the exemplary embodiment described with reference to FIGS. 6 to 8. FIG. 16 is a view illustrating an example of a PEQ set-up in the electronic device of FIG. 15. FIG. 17 is a view illustrating a sound pressure level after equalization in the electronic device of FIG. 15. Referring to FIGS. 16 and 17, in the modified example of the electronic device, it is seen that the sound pressure waveform S1'+S2' of the sum of the sound pressure waveforms of the sounds output from the woofer and the tweeter is relatively flat over the whole frequency band through adapted equalization.

The electronic device according to the previously described exemplary embodiments has the following effects.

The sound plate may serve as a stand. Also, since the self vibration of the sound plate may be restrained by a weight of the main body, the electronic device is strong against vibration.

Also, since the main body is separated from the sound plate that is the speaker system of the main body, the main body may be ultra-slim.

Also, since the sound plate is a vibration source that is separated from the main body, the mechanical design of the main body may focus on overcoming thermal emission limitations.

Also, since the sound plate is a vibration source that is separated from the main body, the vibration limitation of the main body may be solved and the sound playback and articulation with respect to the low-pitched sound may be improved. Also, the sound pressure dip due to the path difference of the rear-side sound does not occur.

Also, a sound quality similar to that of the front-firing type speaker may be secured, and the sound plate may expect superior low frequency extension and high frequency range recording having high articulation through adapted equalization.

Also, the electronic device may have optimum sweet spots at the center and the front surface thereof.

While exemplary embodiments have been particularly shown and described, it will be understood by those of ordinary skill in the art that various changes in form and details may be made therein without departing from the spirit and scope of the inventive concept as defined by the following claims.

What is claimed is:

1. A sound plate comprising:

at least one speaker unit; and a plate in which the at least one speaker unit is disposed, the plate comprising at least one slit through which sound output from the at least one speaker unit is emitted, wherein the plate is configured as a stand to support a main body of an electronic device, and wherein the at least one slit is provided in a side surface of the plate, the at least one slit having a thickness less than an audible wavelength of sound emitted by the at least one speaker unit such that the sound emitted through the at least one slit satisfies a ground plane radiation condition in which the sound is emitted upwardly from a ground at a solid angle of about $2\pi$.

2. The sound plate of claim 1, wherein the at least one speaker unit is disposed in the plate so that an acoustic diaphragm of the at least one speaker unit faces a lower surface of the plate.

3. The sound plate of claim 1, wherein the at least one speaker unit is disposed adjacent to the at least one slit.

4. The sound plate of claim 1, wherein the plate comprises an upper plate and a lower plate coupled to each other such that an inner space formed between the upper plate and the lower plate, and the at least one speaker unit comprises a woofer module and a tweeter module, which are arranged in parallel to one another in the inner space between the upper plate and the lower plate of the plate.

5. The sound plate of claim 4, wherein the woofer module comprises a frame which seals the upper plate and lower plate of the plate to enclose the woofer module within the upper plate and the lower plate.

6. The sound plate of claim 4, wherein the woofer module and the tweeter module are disposed in a pair at a left side and a right side of the speaker module.

7. The sound plate of claim 1, wherein the at least one slit is in one-to-one correspondence to the at least one speaker unit, and the sound output from the at least one speaker unit is independently emitted through the corresponding at least one slit.

8. An electronic device comprising:

a main body that performs a function; and a sound plate comprising:

at least one speaker unit which outputs sound according to a signal transmitted by the main body and a plate in which the at least one speaker unit is disposed, the plate comprising at least one slit through which the sound output from the at least one speaker unit is emitted, wherein the plate is configured as a stand which supports a main body, and wherein the at least one slit is provided in a side surface of the plate, the at least one slit having a thickness less than an audible wavelength of sound emitted by the at least one speaker unit such that the sound emitted through the at least one slit satisfies a ground plane radiation condition in which the sound is emitted upwardly from a ground at a solid angle of about $2\pi$.

9. The electronic device of claim 8, wherein the at least one speaker unit is disposed in the plate so that an acoustic diaphragm pf the at least one speaker unit faces a lower surface of the plate.

10. The electronic device of claim 8, wherein the plate comprises an upper plate and a lower plate coupled to each other such that an inner space formed between the upper plate and the lower plate, and the at least one speaker unit comprises a woofer module and a tweeter module, which are arranged in parallel to one another in the inner space between the upper plate and the lower plate of the plate.

11. The electronic device of claim 10, wherein the woofer module comprises a frame which seals the upper plate and lower plate to enclose the woofer module within the upper plate and the lower plate.

12. The electronic device of claim 10, wherein the woofer module and the tweeter module are disposed in a pair at a left side and a right side of the speaker module.

13. The electronic device of claim 8, wherein the at least one slit is in one-to-one correspondence to the at least one speaker unit, and the sound output from the at least one speaker unit is independently emitted through the corresponding at least one slit.

14. The electronic device of claim 8, wherein the main body comprises a display panel which displays an image.

15. The electronic device of claim 8, wherein the sound plate is detachably coupled to the main body of the electronic device or foldably coupled to a backside of the main body of the electronic device.

16. A sound plate comprising:

a flat plate extending along a plane and comprising at least one slit defined in a side surface which is perpendicular to the plane; and at least one speaker unit which is housed within the flat plate and emits sound through the slit of the flat plate, wherein the at least one speaker unit comprises an acoustic diaphragm which faces in parallel a lower surface of the flat plate which is parallel to the plane.

17. The sound plate of claim 16, further comprising a coupling part which is configured to be coupled to a main body of an electronic device and is disposed on a surface of the flat plate which is parallel to the plane.

18. The slit-firing type sound plate of claim 16, wherein the at least one speaker unit comprises a woofer module and a tweeter module, which are arranged in parallel to one another in a space inside the flat plate.

19. The slit-firing type sound plate of claim 16, wherein the at least one speaker unit is disposed adjacent to the at least one slit.

* * * * *